US007043816B2

(12) United States Patent
Zaluzec et al.

(10) Patent No.: US 7,043,816 B2
(45) Date of Patent: May 16, 2006

(54) METHOD OF MAKING A TWO-PIECE SUPER-PLASTIC FORMED LIGHTWEIGHT ALUMINUM DOOR

(75) Inventors: Matthew John Zaluzec, Canton, MI (US); Fred Goodnow, Novi, MI (US); Kimberly Ann Lazarz, Ypsilanti, MI (US); Rama P Koganti, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 3 days.

(21) Appl. No.: 10/457,121

(22) Filed: Jun. 9, 2003

(65) Prior Publication Data

US 2004/0245676 A1 Dec. 9, 2004

(51) Int. Cl.
*B23P 19/04* (2006.01)

(52) U.S. Cl. ..... 29/460; 29/469.5; 29/509

(58) Field of Classification Search ..... 29/897.2, 29/460 O, 469.5 X, 509 X, 514; 296/146.5, 296/146.9; 49/502
See application file for complete search history.

(56) References Cited

U.S. PATENT DOCUMENTS

| | | | | |
|---|---|---|---|---|
| 4,477,304 | A | 10/1984 | Westermann | |
| 4,719,689 | A * | 1/1988 | Yamamoto et al. | 29/458 |
| 5,273,606 | A * | 12/1993 | Greve et al. | 156/216 |
| 5,449,213 | A * | 9/1995 | Kiley et al. | 296/56 |
| 5,470,416 | A * | 11/1995 | Herring et al. | 156/196 |
| 5,536,060 | A | 7/1996 | Rashid et al. | |
| 5,587,042 | A | 12/1996 | St. Denis | |
| 5,632,413 | A * | 5/1997 | Herring et al. | 222/1 |
| 5,749,992 | A * | 5/1998 | Eklund et al. | 156/212 |
| 5,783,298 | A * | 7/1998 | Herring et al. | 428/323 |
| 5,897,796 | A | 4/1999 | Forrest | |
| 6,000,118 | A * | 12/1999 | Biernat et al. | 29/458 |
| 6,180,199 | B1 * | 1/2001 | Herring et al. | 428/44 |
| 6,324,880 | B1 | 12/2001 | Nakamura | |
| 6,368,008 | B1 * | 4/2002 | Biernat et al. | 403/267 |
| 6,523,244 | B1 * | 2/2003 | Bissonnette | 29/509 |
| 6,696,147 | B1 | 2/2004 | Herring, Jr. | |
| 6,776,449 | B1 | 8/2004 | Komatsu | |
| 2001/0029766 | A1 * | 10/2001 | Wiens | 72/312 |

FOREIGN PATENT DOCUMENTS

| | | |
|---|---|---|
| EP | 0 346 920 B1 | 6/1988 |
| EP | 0 727 343 B1 | 1/1996 |
| JP | 63272428 | 11/1988 |
| JP | 2254070 | 10/1990 |
| JP | 2000-177662 | 6/2000 |

* cited by examiner

*Primary Examiner*—Jerry Redman
(74) *Attorney, Agent, or Firm*—Raymond L. Coppiellie; Brooks & Kushman, P.C.

(57) ABSTRACT

A method of making a vehicle door assembly by assembling a super-plastic formed inner door panel with a super-plastic formed outer panel. A flanging and roll hemming tool are used to form a hem flange to secure the outer door panel to the inner door panel. A room temperature curable two-part epoxy adhesive is used to lock the inner and outer door panels together. The epoxy adhesive is permitted to cure before the assembly is heated in electro-operations or paint ovens. Hinge and striker attachment areas are provided that are not substantially thinned or stretched during the super-plastic forming process so as to preserve the strength of the inner and outer door panels in such areas.

11 Claims, 2 Drawing Sheets

METHOD OF MAKING A TWO-PIECE SUPER-PLASTIC FORMED LIGHTWEIGHT ALUMINUM DOOR

BACKGROUND OF THE INVENTION

1. Field of the Invention

The present invention relates to the manufacture of vehicle doors.

2. Background Art

Conventional vehicle doors are generally stamped from steel blanks in a press forming line including a first drawing step followed by trimming, flanging, and piercing operations. Normally, an inner door panel and an outer door panel are formed in separate stamping operations. The inner and outer door panels are then assembled together with reinforcement bars, brackets and other components. It is not unusual for a conventional vehicle door to have as many as 20 pieces in the completed assembly.

Doors made by a stamping process are limited by manufacturing constraints to relatively shallow contours and are limited to the extent that feature lines may be formed in the door panels. For example, stamped doors cannot be made with feature lines that originate in a flat surface at the middle of a panel.

Conventional vehicle doors made with a large number of pieces tend to suffer from a lack of dimensional control due to the stack up of tolerances permitted for each part. Poor dimensional control adversely impacts vehicle craftsmanship and quality assessment target achievement. Parts are made within a certain degree of dimensional tolerance but when additional parts are assembled together, the tolerances may accumulate making it difficult to control the final dimensional tolerances of the finished door assembly.

It has been proposed to manufacture vehicle doors from aluminum to save weight. Aluminum doors made in a conventional stamping line must generally be manufactured from aluminum sheet that is less than 0.9 mm in thickness. If thicker aluminum sheet is used, excessive splitting and cracking may occur especially in tight radius bends. Door inner and outer panels made with 0.9 mm aluminum are too thin generally to accept mounting hardware without additional reinforcement.

Super-plastic forming (SPF) technology has been used in the manufacture of vehicles including the manufacture of decklids and hoods. In one such door, aluminum having a thickness of 0.9 mm is super-plastic formed and a cast hinge plate and cast striker plate are secured to reinforce the door mounting hardware.

It has also been proposed to use thermally cured adhesives to aid in securing panels of vehicle parts together. Thermally cured adhesives may shift when heated in an oven. Any shift in the position of the door inner relative to the door outer can result in unacceptable dimensional variation.

There is a need for a lightweight vehicle door structure that does not require added reinforcements other than those integrally formed in the inner door panel. Adding reinforcements increases the weight of the overall door assembly.

Further, vehicle fit and finish requirements for world class vehicle manufacturing demand dimensional control of the inner and outer door panels to within 1 mm and of the assembled door inner and outer to be less than 1.25 mm. There is also a need for a manufacturing process that permits wider latitude in design shape and feature line capability.

It would be desirable to reduce the total part count by eliminating reinforcements, such as door hinge and latch reinforcements, and at the same time there is a need for greater dimensional control. Further, there is a need for a vehicle door that does not distort or shift in position when exposed to heat during electro-coat processes and in paint ovens.

These and other problems and needs are addressed by applicants' invention as summarized below.

SUMMARY OF THE INVENTION

According to one aspect of the present invention, a method of making a vehicle door is provided that comprises super-plastic forming inner and outer door panels that are subsequently trimmed and assembled together. A peripheral flange is formed on the outer door panel and a two-part adhesive is applied to the inner door panel in areas adjacent to the peripheral flange of the outer door panel. The peripheral flange is hemmed over the inner door panel to secure the inner and outer door panels together. The two-part adhesive is cured to secure the inner and outer door panels together.

According to other aspects of the invention, the two-part adhesive may be a room temperature curable epoxy adhesive and the inner and outer door panels may be formed from aluminum alloy such as 5083 aluminum alloy that is available from Sky Aluminum Company. The door may be subsequently heated in an oven after the curing step is completed.

Other aspects of the invention relate to hinge attachment and striker hardware attachment areas on the door panels. During the super-plastic forming step, the hinge attachment area and striker hardware attachment area are not substantially thinned or stretched so as to reduce their strength. No reinforcement members are required to be added to the door assembly because these areas maintain their strength and thickness.

According to another aspect of the present invention, a vehicle door assembly is provided that comprises an aluminum super-plastic formed inner door panel having an outwardly extending perimeter flange. The door also includes an aluminum super-plastic formed outer panel having an outer perimeter flange that encompasses the inner perimeter flange of the inner door panel in a reversely turned hem configuration. The inner door panel flange and outer perimeter flange of the outer door panel are bonded together with an adhesive to form a monolithic door structure without additional reinforcements being required for structural integrity.

According to other aspects of the invention as they relate to a vehicle door assembly, the door assembly may have a hinge attachment area and a striker hardware attachment area that are not substantially stretched or thinned during the super-plastic forming process. The inner and outer door panels may be formed from aluminum sheet metal blanks that are 1.5 millimeters thick. The inner and outer door panels are joined by a two-part room temperature curable epoxy adhesive. The inner and outer door panels are also held together by a roll formed hem flange in addition to the adhesive. Other components may be attached to the door assembly but no reinforcements or brackets are required to enforce the structural integrity of the door assembly.

These and other aspects of the invention will be better understood in view of the attached drawings and subsequent detailed description of the illustrated embodiment of the invention.

DETAILED DESCRIPTION OF THE PREFERRED EMBODIMENT(S)

Figure 1:
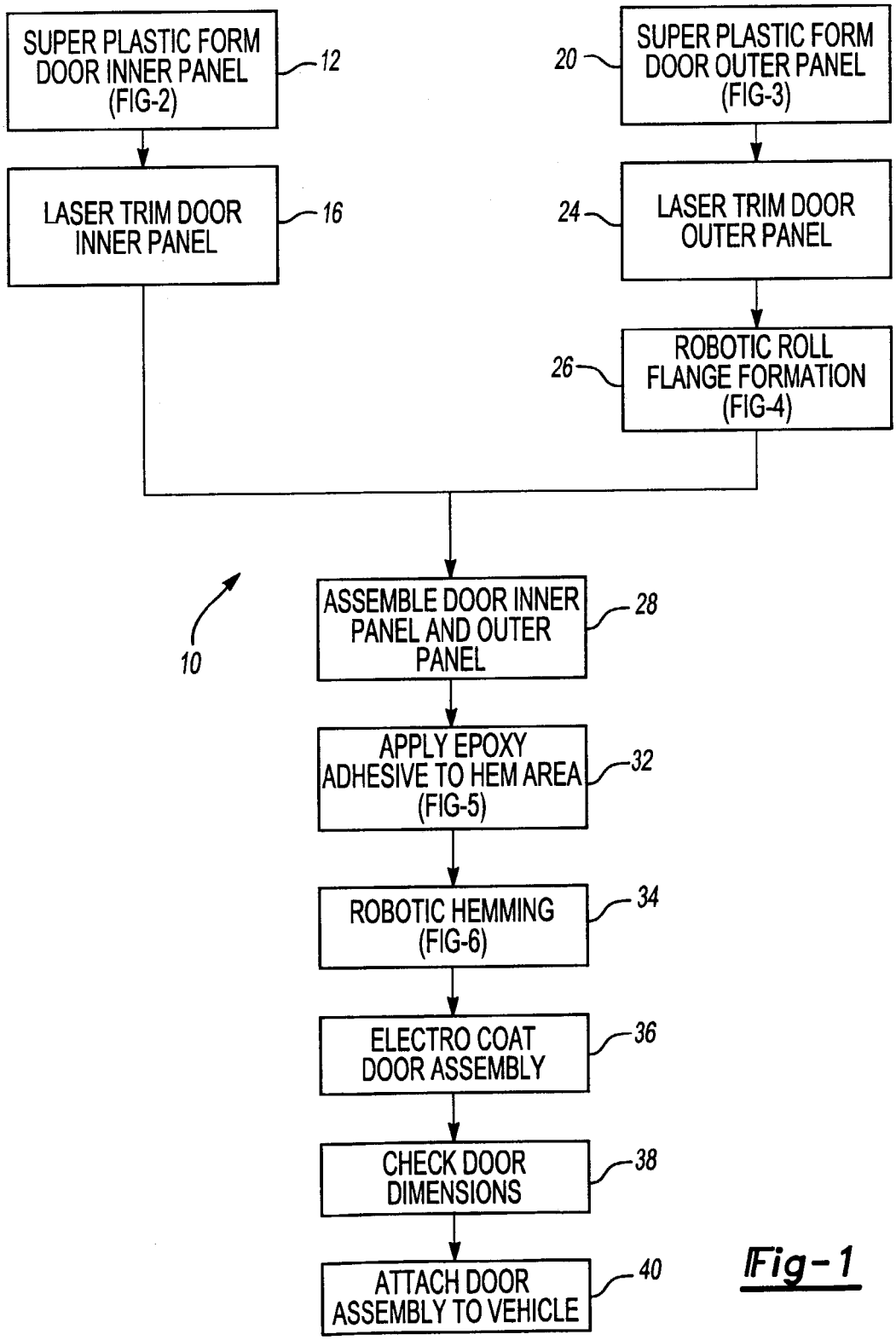
FIG. 1 is a flow chart illustrating the steps of a process for forming a door assembly.
Figure 2:
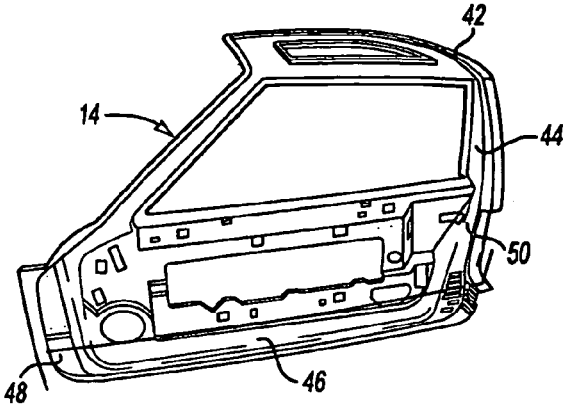
FIG. 2 is a perspective view of a door inner panel made according to the present invention.

Referring to FIG. 1, the process, generally indicated by reference numeral 10, is illustrated by a flow chart. The process begins by super-plastic forming a door inner panel 14 as shown in FIG. 2. After forming, the door inner panel 14 is trimmed at 16. The trimming operation may be performed in two steps comprising a rough trim and a finished trim. The trimming operation may be performed by means of a laser trimming tool or by other trimming tools such as water jet cutting, routering or other mechanical shear or trimming tools.

Figure 3:
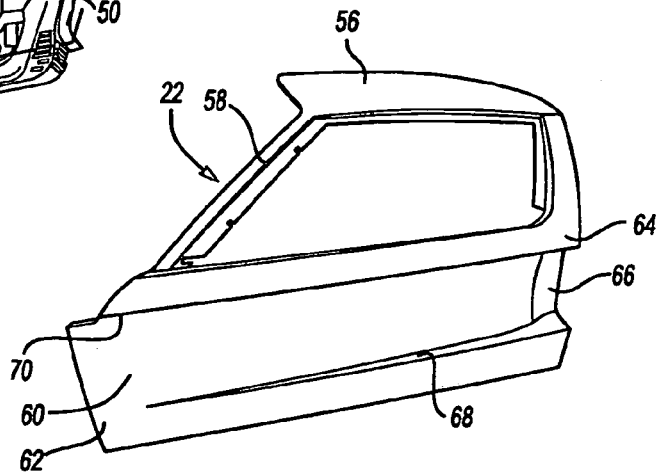
FIG. 3 is perspective view of a door outer panel made according to the present invention.
Figure 6:
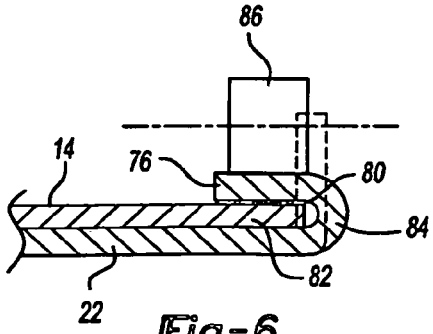
FIG. 6 is a fragmentary schematic cross-sectional view showing the outer door panel being hemmed to the inner panel by a roll hemming process.

In a parallel process a super-plastic forming operation is used to form the door outer panel 22 as illustrated in FIG. 3. The door outer panel 22 is trimmed, at 24, preferably with a laser trim tool, however, other methods of trimming may be used to form the outer panel 22 to its specified dimensions with a tolerance of 1 millimeter. A flange is formed preferably by a robotic roll forming machine at 26. The flange is shown schematically in FIG. 4 and will be described more fully below. Next, the inner and outer door panels are assembled at 28 by placing them together. An epoxy adhesive is applied to the hem area at 32 and is illustrated schematically in FIG. 5. A hem is formed by a robotic roll form operation at 34 and as illustrated by FIG. 6. After hemming, the door assembly is electro-coated at 36 and the door assembly is then checked dimensionally at 38. Finally, the door assembly is attached to a vehicle at 40.

Referring to FIG. 2, a door inner panel is shown and will be described in greater detail. The door inner panel 14 has a roof reinforcement section 42, a window frame reinforcement section 44, and a lower door reinforcement section 46. The roof reinforcement section 42 extends partially across a roof area of the vehicle and is oriented at angle approximately 90° relative to the plane of the lower door reinforcement section 46. The inner panel 14 includes a hinge attachment area 48 and a striker attachment area 50. The door hinge is attached to the hinge attachment area 48 while the door latch and lock mechanism is attached to the striker attachment area 50. The door inner panel is contoured to receive a scoop portion 66 of the outer panel 22 as described more specifically below.

The outer panel 22 includes a roof section 56, a window frame section 58, and a lower door section 60. The roof section 56 and lower door section 60 extend in planes that are generally perpendicular to each other. The outer panel 22 also includes an outer panel hinge attachment area 62 and an outer panel striker attachment area 64 that combine with a hinge attachment area 48 and striker attachment area 50 of the inner door to provide a rigid mounting surface for the hinge and striker. The outer panel 22 defines a scoop 66 that funnels air to the rear engine compartment in the illustrated door. The scoop 66 is defined on its lower edge by an emergent feature line 68 that emerges from a flat portion of the door outer panel 22. A continuous feature line 70 extends across the top of the scoop 66.

Figure 4:
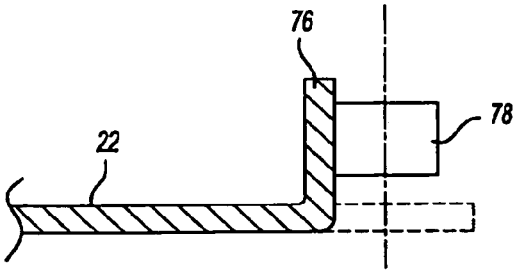
FIG. 4 is a fragmentary schematic cross-sectional view showing a hem flange being formed by a roll forming tool on a door outer panel.

Referring to FIG. 4, the step of roll forming a flange on the outer panel 22 is illustrated. The flange is formed by engaging a peripheral flange 76 with a flange roll forming tool 78. The flange 76 is roll formed to begin the process of forming a hem.

Figure 5:
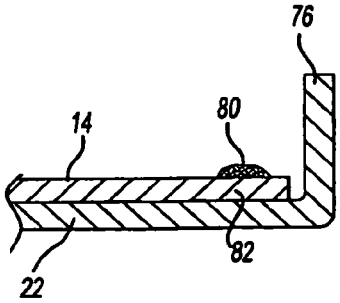
FIG. 5 is a fragmentary schematic cross-sectional view showing inner and outer door panels having an adhesive applied in the hem flange area prior to the final hemming operation.

Referring to FIG. 5, the inner door panel 14 and outer door panel 22 are illustrated with an adhesive 80 applied to a peripheral portion 82 of the inner panel 14. The flange 76 of the outer panel 22 is shown extending approximately 90° relative to the plane of the outer door panel 22. The adhesive 80 may be a room temperature curable two-part epoxy adhesive. By using a room temperature curable adhesive 80 the inner and outer door panels 14 and 22 may become securely locked together before further processing steps are performed on the door. In particular, the adhesive 80 is intended to cure fully before the door assembly is attached to the vehicle and well before the door assembly is heated in electro-coat or paint ovens.

Referring to FIG. 6, the peripheral flange 76 of the outer door panel 22 is shown hemmed over the inner door panel 14. The two-part epoxy adhesive 80 is shown between the peripheral flange 76 and the peripheral portion 82 of the inner panel 14. (The thickness of the adhesive 80 as shown in FIG. 6 is exaggerated for purposes of illustration.) The peripheral flange 76 is formed with a reverse turn 84 by a hem roll forming tool 86.

While the best mode for carrying out the invention has been described in detail, those familiar with the art to which this invention relates will recognize various alternative designs and embodiments for practicing the invention as defined by the following claims.

What is claimed:

1. A method of making a vehicle door comprising:

super-plastic forming an inner door panel;

trimming the inner door panel;

super-plastic forming an outer door panel;

trimming the outer door panel;

positioning a first surface of the inner door panel in contact with the outer door panel;

forming a peripheral flange on the outer door panel after positioning the inner door panel;

applying a two-part adhesive to a second surface of the inner door panel disposed opposite the first surface in areas adjacent the peripheral flange after forming the peripheral flange;

hemming the peripheral flange over the inner door panel after applying the two-part adhesive and adhering the peripheral flange to the inner door panel with the two-part adhesive; and curing the two-part adhesive to lock the inner door panel and the outer door panel together.

2. The method of claim 1 further comprising applying an electro-coat layer to the inner door panel and to the outer door panel after the inner and outer door panels are assembled together.

3. The method of claim 1 wherein the two-part adhesive is a room temperature curable epoxy adhesive.

4. The method of claim 1 wherein the inner and outer door panels are formed from an aluminum alloy.

5. The method of claim 4 wherein the aluminum alloy is 5083 aluminum alloy.

6. The method of claim 1 wherein the door is subsequently heated in an oven after the curing step is completed.

7. The method of claim 1 wherein the inner and outer door panels have a hinge attachment area and a striker hardware attachment area, and wherein during the super-plastic forming steps the hinge attachment areas and striker hardware attachment areas are not substantially thinned or stretched so as to reduce the strength of such areas.

8. The method of claim 7 wherein no reinforcement members are provided in the hinge attachment area and striker hardware attachment area.

9. The method of claim 1 wherein the hemming step is performed in a roll hemming operation.

10. The method of claim 1 further comprising applying an electro-coat layer to a majority of exterior surfaces of the inner and outer panels.

11. A method of making a vehicle door comprising:

super-plastic forming an inner door panel;

trimming the inner door panel;

super-plastic forming an outer door panel;

trimming the outer door panel;

positioning a first surface of the inner door panel against an inner surface of the outer door panel;

forming a peripheral flange on the outer door panel after positioning the inner door panel, the peripheral flange extending generally perpendicular to the outer door panel such that the peripheral flange does not overlap a second surface of the inner door panel disposed opposite the first surface;

applying a two-part adhesive only on the second surface of the inner door panel after forming the peripheral flange;

hemming the peripheral flange over the inner door panel after applying the two-part adhesive and adhering the peripheral flange to the inner door panel with the two-part adhesive; and curing the two-part adhesive to lock the inner door panel and the outer door panel together.

* * * * *